US005195761A

United States Patent [19]

Eimer

[11] Patent Number: 5,195,761

[45] Date of Patent: Mar. 23, 1993

[54] CHUCK FOR TOOL INSERTS, ESPECIALLY SCREWDRIVER BITS

[75] Inventor: Wilfried Eimer, Schonach, Fed. Rep. of Germany

[73] Assignee: Willi Hahn GmbH & Co., KG, Schonach, Fed. Rep. of Germany

[21] Appl. No.: 795,879

[22] Filed: Nov. 25, 1991

[30] Foreign Application Priority Data

Oct. 31, 1990 [DE] Fed. Rep. of Germany ... 9014997[U]

[51] Int. Cl.[5] ..... B25B 23/00

[52] U.S. Cl. ..... 279/90; 81/439; 279/128; 279/904

[58] Field of Search ..... 81/438, 439, 489, 490; 279/76–78, 81, 89, 90, 128, 904, 905, 91, 95, 102, 1.13

[56] References Cited

U.S. PATENT DOCUMENTS

| | | | |
|---|---|---|---|
| 1,203,853 | 11/1916 | Contal | 279/90 |
| 1,413,101 | 4/1922 | Cushing | 279/89 |
| 1,418,184 | 5/1922 | Trunick | 81/438 X |
| 1,758,069 | 5/1930 | Abramson . | |
| 2,550,775 | 5/1951 | Clark | 279/128 X |
| 2,592,978 | 4/1952 | Trimboli . | |
| 3,672,692 | 6/1972 | Fauth | 279/905 X |
| 4,668,119 | 5/1987 | Galletti | 403/349 |
| 4,924,733 | 5/1990 | McKenzie | 81/439 X |

FOREIGN PATENT DOCUMENTS

| | | |
|---|---|---|
| 915080 | 7/1954 | Fed. Rep. of Germany . |
| 924436 | 3/1955 | Fed. Rep. of Germany . |
| 1030268 | 5/1958 | Fed. Rep. of Germany . |
| 3314232 | 10/1984 | Fed. Rep. of Germany . |
| 3526582 | 2/1987 | Fed. Rep. of Germany . |
| 3538675 | 5/1987 | Fed. Rep. of Germany . |
| 3737255 | 1/1989 | Fed. Rep. of Germany . |
| 3829331 | 3/1990 | Fed. Rep. of Germany . |

OTHER PUBLICATIONS

Deutsche Institut furNormung (DIN-Norm) pp. 134–141, Mar. 1987.

*Primary Examiner*—Steven C. Bishop

*Attorney, Agent, or Firm*—Mason, Fenwick & Lawrence

[57] ABSTRACT

A chuck is provided for receiving and holding inserts having a non-circular shaft. The chuck includes a body having a non-circular cavity, and a capping sleeve rotatable on the body and extending beyond an end of the body. A locking plate is provided in the portion of the capping sleeve which extends beyond the end of the body, the locking plate having a non-circular opening with a profile corresponding to the profile of the cavity. The capping sleeve may be rotated relative to the body to the place the profile of the locking plate selectively in registry, or not, with the profile of the cavity.

4 Claims, 3 Drawing Sheets

CHUCK FOR TOOL INSERTS, ESPECIALLY SCREWDRIVER BITS

BACKGROUND OF THE INVENTION

The invention relates to a chuck for tool inserts.

A chuck for tool inserts, especially screw driver bits, of this genus is described in DE 3,829,331 A1. In this chuck, the tool insert used is forcibly held in place by means of a self-locking ball, where the ball is clamped between one of the six faces of the shaft of the tool insert which is inserted into the chuck and the tapering wall surface of a capping sleeve which is displaceable in the axial direction. To withdraw the tool insert which may be a bit, the ball must be released by displacement of the capping sleeve.

A disadvantage with chucks of this kind is the use of a ball which can be displaced and clamped in the chuck. This necessitates a costly construction for guiding the ball; furthermore, the functioning of the ball can be impaired by contaminants (e.g. foreign bodies) which find their way into the chuck.

In accordance with German Standard DIN 3126-C, it is known to provide tool inserts with a shaft having a hexagonal cross-section, with notches in the longitudinal edges of this hexagonal shaft; these notches form a snap-fit groove in the circumference of the shaft. The hexagonal shaft engages in the hexagonal cavity of a chuck, where a lock washer seated in the hexagonal cavity enters into this snap-fit groove. It is further known form DE 3,538,675 A1 to turn down the hexagonal shaft of the tool insert, from the working end as far as this snap-fit groove, so that the lock washer of the chuck engages ahead of the turned-down hexagonal shaft.

In these chucks, the tool insert is held in place by the spring action of the lock washer. A high spring force of the lock washer makes it difficult to change the tool insert, while a weak spring force results in an unreliable retention of the tool insert. In addition, metal fatigue which develops in the lock washer also makes unreliable the retention of the tool insert.

The object of the invention is to provide a chuck of the above-indicated type, which offers high operating reliability, is simple to manipulate and has a simple form of construction.

SUMMARY OF THE INVENTION

In the chuck in accordance with the invention, locking of the tool insert is effected by means of a small locking plate which is inserted in a capping sleeve rotatable about the longitudinal axis of the chuck. In a release position of the capping sleeve, the profile of a non-circular hole in the locking plate is made to register with the non-circular profile of the cavity of the chuck, so that the tool insert can be readily inserted in the cavity or can be readily removed from it. If the capping sleeve is rotated into a locking position, the locking plate engages in the snap-fit groove of the shaft, e.g. in the snap-fit groove present in the hexagonal shaft in screwdriver inserts in accordance with DIN 3126 Form c, or ahead of the shaft of the screwdriver insert which is turned down from the working side as far as this snap-fit groove in accordance with DE 3,538,675 A1; and it is held in this position by means of the capping sleeve, preferably in a spring-loaded manner. In this way, the number of moving parts of the chuck is minimized. Furthermore, the tool insert is held in the chuck exclusively in a positively locked manner. This avoids both a pressure exerted radially on the tool insert from only one direction, as well as spring-action clamping elements of material subject to fatigue. Since only forcibly guided elements, and no freely movable clamping elements (e.g. a clamping ball), are used, the operating safety and reliability of the chuck will be impaired to a lesser extent by contaminants. The reduction in the number of structural parts also permits a simpler and hence a more economical manufacture of the chuck.

The fixing of the tool insert by means of a rotatable locking plate enables the axial length of the chuck in accordance with the invention to be shorter than that of known chucks having axially displaceable elements; this makes it possible, advantageously, to increase the length of the free end of the screwdriver bit.

BRIEF DESCRIPTION OF THE DRAWINGS

The invention will now be further elucidated with the aid of an embodiment represented in the drawing.

DESCRIPTION OF THE PREFERRED EMBODIMENTS

Figure 2:
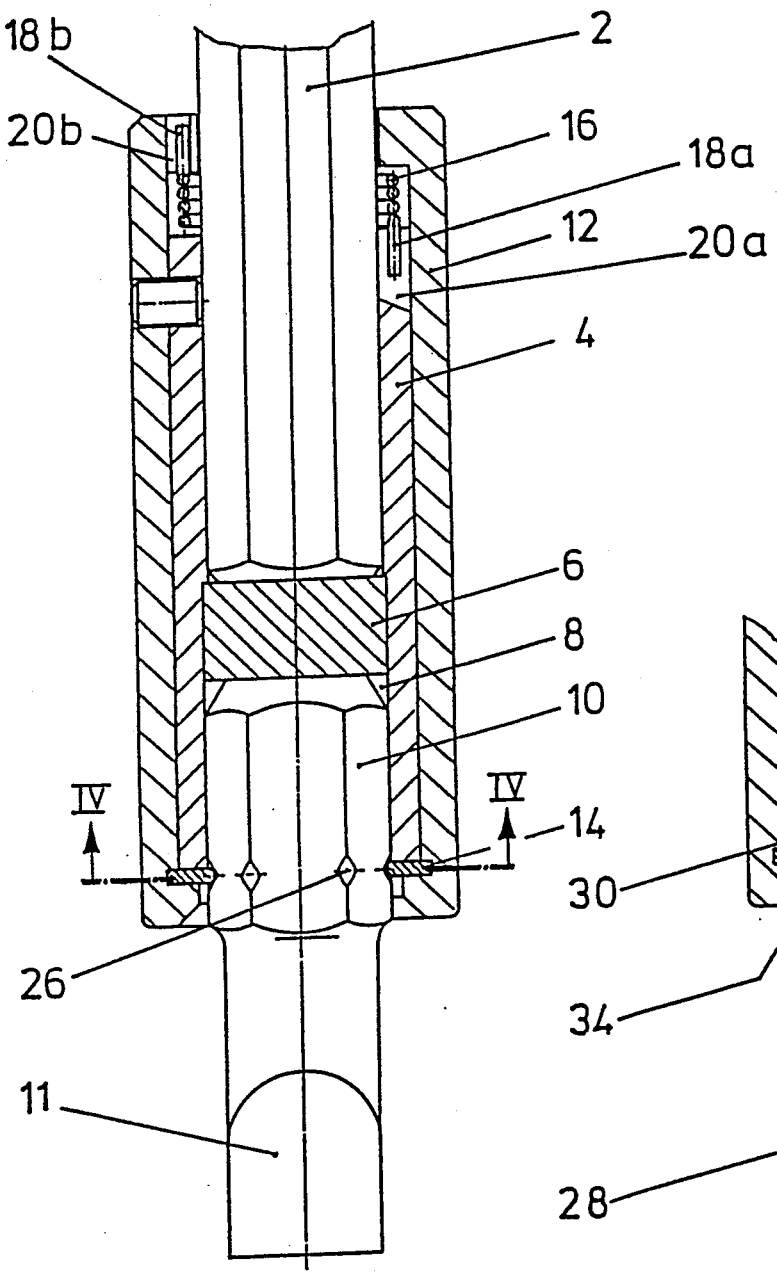
FIG. 2 is a longitudinal section through the chuck of FIG. 1 with an inserted screwdriver bit having a snap-fit groove.

The chuck has a clamping lug 2 to which a sleeve-shaped body 4 is attached (see FIG. 2). A strike 6 is inserted in body 4 in the central region. This strike serves to limit the insertion depth of the tool insert. This strike 6 can also advantageously consist of a magnet, which serves to exert a magnetic force on the screw through the tool inserts, e.g. screwdriver bits. In the forward region, body 4 has a hexagonal cavity 8 with a cross sectional profile which corresponds to the cross section of the hexagonal shaft 10 or 30 of a screwdriver bit or 28, respectively.

Figure 4A:
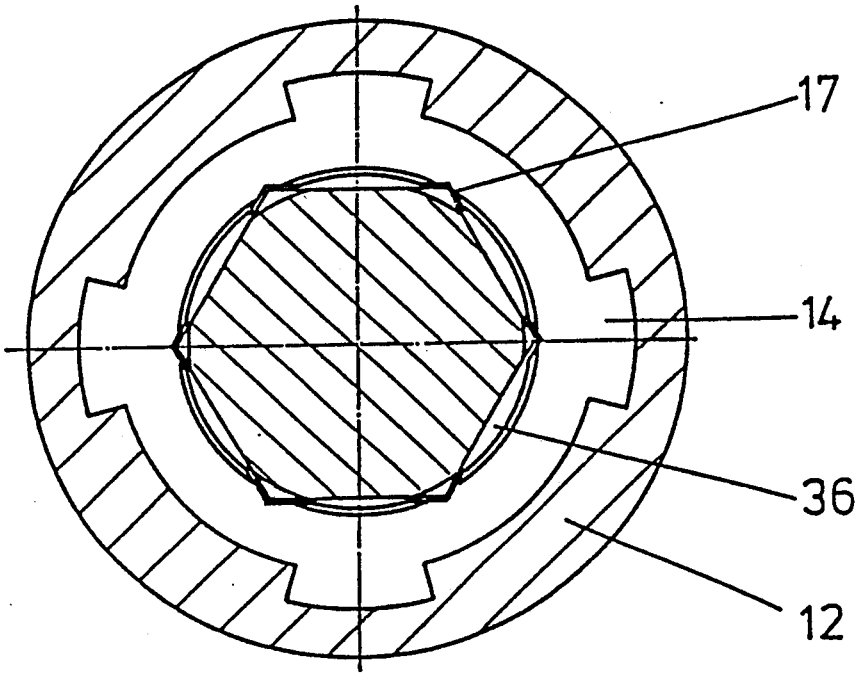
FIG. 4*a* is a cross section of the chuck taken along the line IV—IV in FIG. 2 in the release position.
Figure 4B:
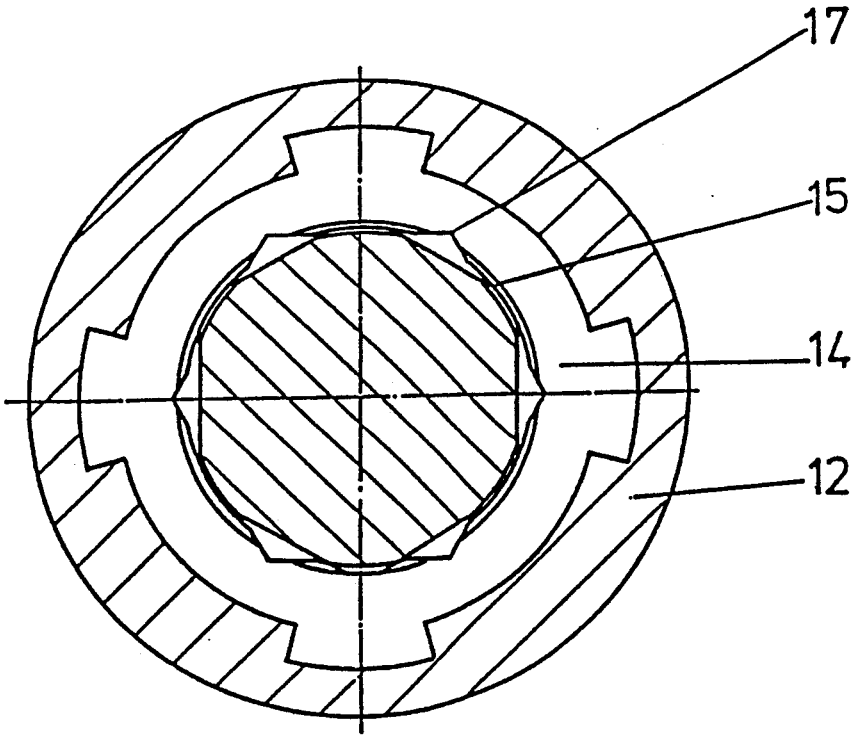
FIG. 4*b* is a corresponding cross section of the chuck in the locking position.

A capping sleeve 12 is mounted rotatably on body 4, and projects beyond body 4 at both ends. Capping sleeve 12 extends inwardly over the end of body 4 which faces the clamping lug, as far as the external circumference of clamping lug 2. A small locking plate 14 adjoins the end of body 4 which faces the insertion end; this plate 14 is firmly seated in capping sleeve 12. Locking plate 14, as shown in FIGS. 4*a* and 4*b*, has a central circular hole 15, whose internal diameter corresponds to the diameter of snap-fit groove 26 of hexagonal shaft 10 of standardized tool inserts (DIN 3126 Form c). Hole 15 is enlarged over its circular internal circumference by six essentially triangular-shaped, equidistantly spaced recesses 17, which correspond in profile to the hexagonal edges of shaft 10 or 30 of the tool insert.

Figure 1:
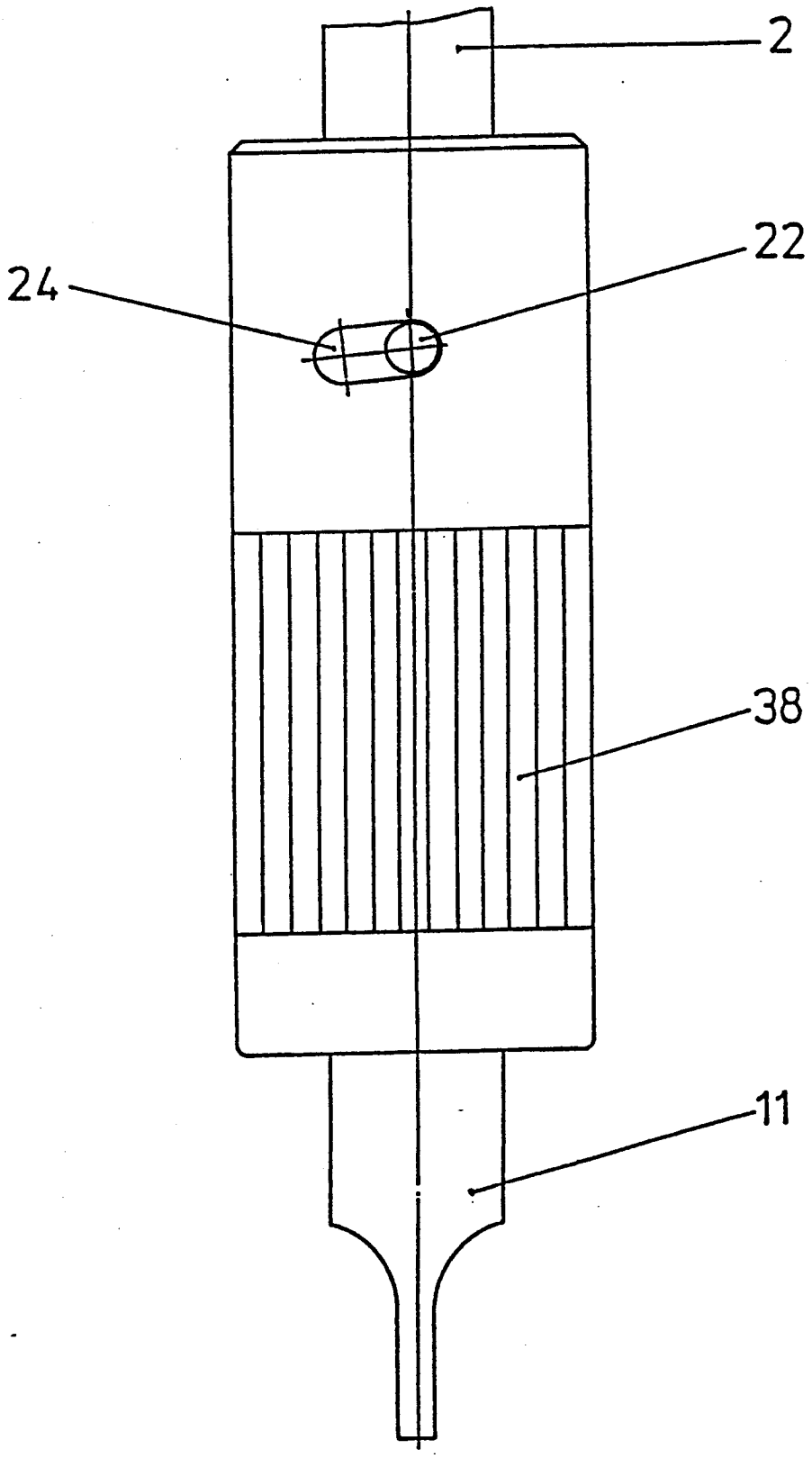
FIG. 1 is a side view of a chuck in accordance with the invention which holds a screw-driver bit.

A coil spring 16 is circumferentially seated on clamping lug 2 between the ends of body 4 and capping sleeve 12. The two ends 18*a* and 18*b* of coil spring 16 lie respectively, under the spring tension of coil spring 16, against spring-seat faces 20*a* and 20*b*, which are adjacent hollowed out portions of body 4 and capping sleeve 12, respectively. The angle of rotation between body 4 and capping sleeve 12 is limited, as shown in FIGS. 1 and 2, by a radial pin 22 inserted in body 4. This pin 22 engages in a slot 24 which runs in the circumferential direction in capping sleeve 12 (see FIG. 1). The torsional tension of coil spring 16 holds pin 22 against a striking end of slit 24. In this locking position, triangular recesses 17 of the small locking plate 14 do not coincide with the profile corners of hexagonal cavity 8 of body 4. Body 4 and capping sleeve 12 can be turned manually relative to each other, against the spring tension, over the length of slot 24 until pin 2 reaches the other striking end of slit 24. In this release position, the profile provided by recesses 17 in locking plate 14 coincide with the profile provided by the corners of hexagonal cavity 8.

Figure 3:
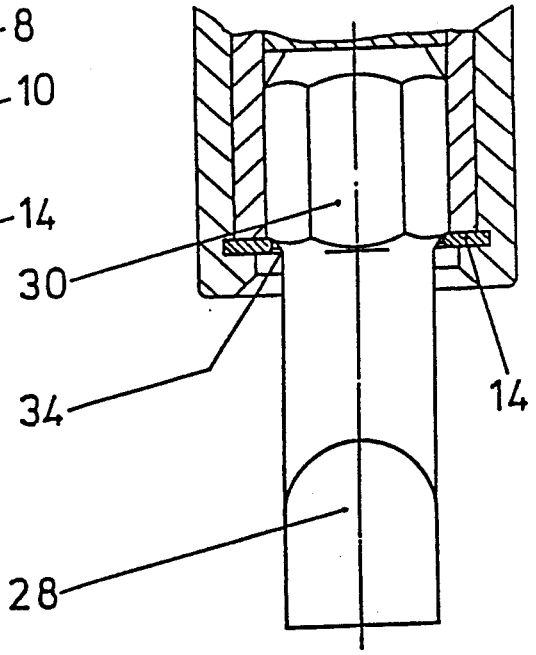
FIG. 3 is a partial longitudinal section through the chuck of FIG. 1 with an inserted screwdriver bit having a turned-down shaft.

Suitable accessories for the chuck are tool inserts 11, e.g. screwdriver bits, which have a snap-fit grove 26 in accordance with DIN 3126-c (FIG. 2). Tool inserts 28 can also be used, whose shaft 30 is rounded from the working end as far as the region of such a snap-fit groove 26 (FIG. 3). To insert the tool insert 11 or 28 in the chuck, capping sleeve 12 is rotated on body 4, against the spring action of coil spring 16, to the release position (FIG. 4*a*), in which hole profile 36 of locking plate 14 is in registry with the cross sectional profile of hexagonal cavity 8, and shaft 10 or 30 can be introduced through locking plate 14 into body 4. The screwdriver bit 11, inserted into hexagonal cavity 8, is then held by locking plate 14 which snaps back into the positively locked position owing to the spring force and engages in snap-fit groove 26. In the case of tool inserts 28 in which the shaft has been rounded axially as far as the snap-fit groove, locking plate 14 lies against the rounded working end 34 of shaft 30.

To withdraw screwdriver bit 11 or 28, capping sleeve 12 is rotated, opposing the spring force, until, in the release position (FIG. 4*a*) the hole profile 36 of locking plate 14 is made to coincide with the profile of hexagonal cavity 8 of body 4. Tool insert 11 or 28 can then be removed easily.

The slightly inclined position of slot 24 relative to the plane perpendicular to the axis of capping sleeve 12 has two effects: First, during rotation into the release position, locking plate 14 is lifted away from the face of body 4 and the rotation is not impeded by friction. Second, this removes the stress on tool insert 11 or 28. During rotation into the locking position, on the other hand, tool insert 11 or 28 is pressed lightly, by locking plate 14, into hexagonal holder 8 (especially in the embodiment depicted in FIG. 3), and seated axially against strike 6.

The outer surface of capping sleeve 12 is shaped as a ridged handle 38, so that capping sleeve 12 can be rotated comfortably relative to body 4.

I claim:

1. A chuck for a tool insert having a non-circular shaft comprising:

a body having a non-circular cavity having a profile, a capping sleeve rotatable on said body, and extending beyond one end of said body, a locking plate within a non-rotatably attached to said capping sleeve beyond said one end of said body, said locking plate having a central circular hole and outwardly extending recesses which provide a profile that corresponds to the profile of said non-circular cavity, means for urging said capping sleeve to a position in which said profiles are not in registry, means for limiting rotation of said capping sleeve between positions of in registry and out of registry of said profiles comprising a pin in one of the body and capping sleeve and a slot in the other of the body and capping sleeve receiving said pin therein, said slot being inclined relative to a plane perpendicular to the capping sleeve and comprising means for moving said capping sleeve axially to extend further beyond the said end of said body as said capping sleeve and body are relatively moved to the said position of registry, whereby said capping sleeve may be rotated to selectively position said profile of said locking plate in or out of registry with said profile of said cavity and to axially move a tool in said cavity engaged by said locking plate.

2. The chuck of claim 1, and further comprising a magnet in said body positioned to be engaged by an insert placed in said cavity.

3. A chuck for a tool insert having a non-circular shaft comprising:

a body having a cavity therein having a non-circular profile, a capping sleeve rotatable on said body and extending beyond one end of said body, a locking plate within and non-rotatably attached to said capping sleeve and located beyond said one end of said body, said locking plate having a non-circular hole therein, providing a profile which corresponds to said non-circular profile of said cavity in said body, means for urging said capping sleeve to a position in which said profiles are not in registry, means for limiting rotation of said capping sleeve between positions of in registry and out of registry of said profiles, and means for causing said capping sleeve and said locking plate to move axially upon rotation of said capping sleeve on said body, whereby said capping sleeve may be rotated to selectively position said profile of said locking plate in or out of registry with said profile of said cavity and to axially move a tool in said cavity engaged by said locking plate.

4. The chuck of claim 3, and further comprising a magnet in said body positioned to be engaged by an insert placed in said cavity.

* * * * *